US008634991B2

(12) United States Patent
Douglas

(10) Patent No.: US 8,634,991 B2
(45) Date of Patent: Jan. 21, 2014

(54) GRADE CONTROL FOR AN EARTHMOVING SYSTEM AT HIGHER MACHINE SPEEDS

(75) Inventor: Frank Beard Douglas, Tipp City, OH (US)

(73) Assignee: Caterpillar Trimble Control Technologies LLC, Dayton, OH (US)

( * ) Notice: Subject to any disclaimer, the term of this patent is extended or adjusted under 35 U.S.C. 154(b) by 548 days.

(21) Appl. No.: 12/828,645

(22) Filed: Jul. 1, 2010

(65) Prior Publication Data

US 2012/0000681 A1 Jan. 5, 2012

(51) Int. Cl.
*E02F 3/76* (2006.01)

(52) U.S. Cl.
USPC ..... 701/50; 172/4.5

(58) Field of Classification Search
USPC ..... 701/50; 172/4.5
See application file for complete search history.

(56) References Cited

U.S. PATENT DOCUMENTS

| | | | | |
|---|---|---|---|---|
| 4,085,805 | A * | 4/1978 | Hawkins et al. | 172/4.5 |
| 4,923,015 | A * | 5/1990 | Barsby et al. | 172/4.5 |
| 5,560,431 | A * | 10/1996 | Stratton | 172/2 |
| 5,860,480 | A | 1/1999 | Jayaraman et al. | |
| 5,935,183 | A * | 8/1999 | Sahm et al. | 701/50 |
| 5,950,141 | A | 9/1999 | Yamamoto et al. | |
| 5,951,613 | A * | 9/1999 | Sahm et al. | 701/50 |
| 6,108,076 | A | 8/2000 | Hanseder | |
| 6,112,145 | A * | 8/2000 | Zachman | 701/50 |
| 6,421,627 | B1 | 7/2002 | Ericsson | |
| 7,003,386 | B1 * | 2/2006 | Ericsson et al. | 701/50 |
| 7,121,355 | B2 * | 10/2006 | Lumpkins et al. | 172/4.5 |
| 7,317,977 | B2 | 1/2008 | Matrosov | |
| 7,677,323 | B2 * | 3/2010 | Stratton et al. | 172/7 |
| 8,145,391 | B2 * | 3/2012 | Omelchenko et al. | 701/50 |
| 2002/0154948 | A1 | 10/2002 | Brabec et al. | |
| 2006/0042804 | A1 | 3/2006 | Pecchio | |
| 2008/0087447 | A1 | 4/2008 | Piekutowski | |
| 2008/0109141 | A1 | 5/2008 | Nichols et al. | |
| 2009/0222204 | A1 | 9/2009 | Roberts et al. | |

OTHER PUBLICATIONS

Office Action pertaining to German Patent Application No. 10 2011 051 457.0, dated Oct. 24, 2012.

* cited by examiner

*Primary Examiner* — Thomas B Will
*Assistant Examiner* — Joel F. Mitchell
(74) *Attorney, Agent, or Firm* — Dinsmore & Shohl LLP

(57) ABSTRACT

An earthmoving system including a bulldozer has a pair of GPS receivers mounted on the cutting blade of the bulldozer. The cutting blade is supported by a blade support extending from the frame. The blade support includes a pair of hydraulic cylinders for raising and lowering the blade in relation to the frame and a blade tilt cylinder for controlling the lateral tilt of the cutting blade. Sensors, including gyroscopic sensors and an accelerometer, sense rotation of the frame about three orthogonal axes and vertical movement of the bulldozer frame that would affect the position of the blade. A control is responsive to the pair of GPS receivers and to the gyroscopic sensors, for controlling the operation of the hydraulic cylinders and thereby the position of the cutting blade. The control monitors the position of the cutting blade with repeated calculations based on the outputs of the GPS receivers and with low-latency feed-forward correction of these repeated calculations, based on the outputs of the gyroscopic sensors and the accelerometer.

15 Claims, 2 Drawing Sheets

GRADE CONTROL FOR AN EARTHMOVING SYSTEM AT HIGHER MACHINE SPEEDS

CROSS-REFERENCE TO RELATED APPLICATIONS

Not applicable.

STATEMENT REGARDING FEDERALLY SPONSORED RESEARCH OR DEVELOPMENT

Not applicable.

BACKGROUND OF THE INVENTION

The present application relates to an earthmoving system of the type that incorporates a bulldozer for contouring a tract of land to a desired finish shape and, more particularly to a bulldozer system in which the position of the cutting tool is continually updated by GPS receivers and the position is corrected using low latency, feed forward correction signals generated in response to outputs from gyroscopic sensors and an accelerometer that monitors vertical acceleration.

Various control arrangements have been developed to control earthmoving devices, such as bulldozers, so that a tract of land can be graded to a desired level or contour. A number of systems have been developed in which the position of the earthmoving apparatus is determined with GPS receivers. In such systems, a site plan is developed with the desired finish contour. From the tract survey and the site plan, a cut-fill map is produced, showing amounts of cut or fill needed in specific areas of the tract to produce the desired finish contour. The information is then stored in the computer control system on the bulldozer.

The earthmoving apparatus determines the position of the cutting tool of the bulldozer using the GPS receivers mounted on the bulldozer body or on masts attached to the blade of the bulldozer. A computer control system calculates the elevation error of the blade based on the cut-fill map and the detected planar position of the apparatus. The elevation error may be displayed for the operator of the bulldozer who can then make the appropriate adjustments manually. Alternatively, the computer may automatically adjust the elevation of the blade to reduce elevation error.

One limitation encountered with such systems is that the GPS position computations are made at a relatively slow rate, e.g. on the order of several times per second. As a consequence, the control system is only able to determine the position of the machine and the position of the cutting blade relatively slowly. This significantly limits the speed of operation of the bulldozer, especially over rough terrain. It will be appreciated that a bulldozer frame may pitch fore and aft, may pitch from side to side, and may yaw right and left as the bulldozer moves across a bumpy area of a job site. Additionally, the frame of the bulldozer may bounce up and down. All of these movements of the frame are transferred to the blade in front of the bulldozer and may even be amplified, since the blade is positioned well ahead of the center of gravity of the machine, the point about which the rocking and yawing occurs. Lowering the speed of operation of the bulldozer to permit the GPS control system to compensate effectively for the uneven surface conditions of the job site results in an undesirable reduction in productivity.

It is seen that there is a need, therefore, for an earthmoving system and method having a bulldozer or other machine, and including GPS receivers and a control in which compensation is made for inaccuracies in the cutting blade position that would otherwise result from pitching and vertical movement of the bulldozer frame.

SUMMARY

An earthmoving system includes a bulldozer, having a frame and a cutting blade supported by a blade support extending from the frame. The blade support includes a pair of hydraulic cylinders for raising and lowering the blade in relation to the frame and a blade tilt cylinder for controlling the lateral tilt of the cutting blade. A pair of GPS receivers is mounted on the cutting blade of the bulldozer for receiving GPS signals. A first gyroscopic sensor senses rotation of the frame about an axis generally transverse to the bulldozer and passing through the center of gravity of the bulldozer. A second gyroscopic sensor senses rotation of the frame about an axis generally longitudinal with respect to the bulldozer and passing through the center of gravity of the bulldozer. A control is responsive to the pair of GPS receivers and to the first and second gyroscopic sensors for controlling the operation of the hydraulic cylinders and thereby the position of the cutting blade. The control monitors the position of the cutting blade with repeated calculations based on the outputs of the GPS receivers and with low-latency feed-forward correction of the repeated calculations based on the outputs of the first and second gyroscopic sensors.

The control determines rapid changes in the position of the cutting blade based upon the outputs of the first and second gyroscopic sensors. The control periodically updates the actual position of the cutting blade based upon the outputs of the GPS receivers. An accelerometer, mounted on the frame, determines vertical movement of the frame. The accelerometer providing a vertical acceleration output to the control whereby the control may determine rapid changes in the position of the frame which may be transmitted to the cutting blade based on the output of the accelerometer. The control monitors the position of the cutting blade with repeated calculations based on the outputs of the GPS receivers and with low-latency feed-forward correction of the repeated calculations based on the outputs of the first and second gyroscopic sensors and the accelerometer.

The control is responsive to the GPS receivers to determine the heading of the bulldozer. The system may further comprise a third gyroscopic sensor for sensing rotation of the frame about a generally vertical axis passing through the center of gravity of the bulldozer. The generally vertical axis is perpendicular to both the axis generally transverse to the bulldozer and the axis generally longitudinal with respect to the bulldozer. The control monitors the heading of the bulldozer with repeated calculations based on the outputs of the GPS receivers and with low-latency feed-forward correction of the repeated calculations based on the output of the third gyroscopic sensor.

The earthmoving system includes an earthmoving machine, having a frame and a cutting blade supported by a blade support extending from the frame. The blade support includes a pair of hydraulic cylinders for raising and lowering the blade in relation to the frame and a blade tilt cylinder for controlling the lateral tilt of the cutting blade. A gyroscopic sensor system senses rotation of the frame about three orthogonal axes generally passing through the center of gravity of the machine. A control is responsive to the GPS receivers and to the gyroscopic position sensor for detecting the change in position of the cutting blade and controlling the operation of the cylinders and thereby controlling the position of the cutting blade. Repeated calculations based on the outputs of the GPS receivers are corrected by low-latency feed-forward correction signals based on the output of the gyroscopic sensor system.

The control may periodically update the actual position of the cutting blade based upon the outputs of the GPS receivers. The control determines the position of the cutting blade based upon the output of the gyroscopic system a plurality of times between successive determinations of the position of the cutting blade based upon the output of the GPS receivers. The control may be responsive to the GPS receivers to determine the heading of the bulldozer. The gyroscopic system senses rotation of the frame about a generally vertical axis passing through the center of gravity of the bulldozer. The control monitors the heading of the bulldozer with repeated calculations based on the outputs of the GPS receivers and with low-latency feed-forward correction of the repeated calculations based on the output of the gyroscopic system. An accelerometer, mounted on the frame, may be used to determine vertical movement of the frame. The accelerometer provides a vertical acceleration output to the control whereby the control may determine rapid changes in the position of the frame which may be transmitted to the cutting blade based on the output of the accelerometer. The control monitors the position of the cutting blade with repeated calculations based on the outputs of the GPS receivers and with low-latency feed-forward correction of the repeated calculations based on the outputs of the gyroscopic system and the accelerometer.

It is seen that there is a need for an improved earthmoving system.

DETAILED DESCRIPTION OF THE INVENTION

Figure 1:
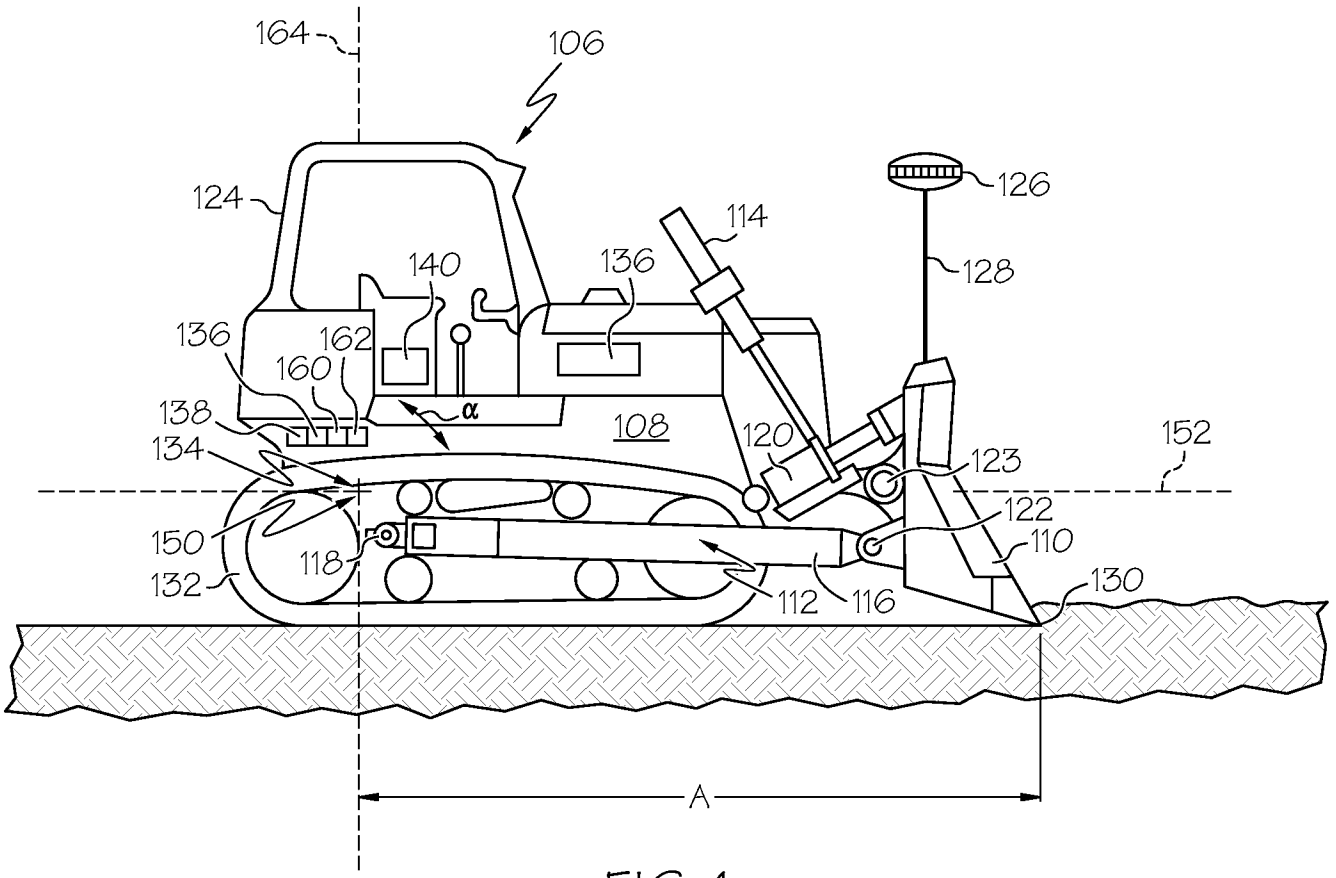
FIG. 1 is a side elevation view of an embodiment of the earthmoving system.

FIG. 1 illustrates an embodiment of the earthmoving system 100, including a bulldozer 106, having a frame 108 and a cutting blade 110. The cutting blade 110 is supported by a blade support 112 that extends from the frame 108. The blade support 112 includes a pair of hydraulic cylinders 114, only one of which is shown in FIG. 1, for raising and lowering the blade 110 in relation to the frame. The blade support 112 further includes a pair of arms 116, one of which is shown in FIG. 1, that are attached to opposite ends of blade 110 and pivotally attached to the frame 108 at 118. Cylinders 114 can be extended or retracted to lower or to raise blade 110, respectively, as arms 112 pivot about 118. Cylinders 120 extend between the top of blade 110 and arms 116 and may be used to pivot the blade about pivot connection 122. A blade tilt cylinder 123 controls the lateral tilt of the cutting blade 110. Bulldozer 106 has a cab 124 from which an operator may manually operate various controls to control the operation of the bulldozer.

The earthmoving system 100 further includes a pair of GPS receivers 126, one of which can be seen in FIG. 1. The GPS receivers 126 are mounted on opposite ends of the cutting blade 110 on masts 128. The GPS receivers receive radio transmissions from satellites in orbit and, based on the time of travel of each of the transmissions, determine the respective positions of the GPS receivers in three dimensional space. This information is supplied to a control 140 on the bulldozer, and is used by the control to determine the location of the cutting blade 110, and in particular the location of the cutting edge 130 of the cutting blade 110.

The GPS receivers 126 detect the position of the blade 110 and the orientation of the blade 110, making automatic control of the bulldozer 106 possible, and facilitating semi-automatic and manual control of the bulldozer 106. The position information is repeatedly calculated and made available to the control 140 at the rate of several times per second. The control 140, however, requires accurate position information more or less continuously. When the bulldozer is travelling across the job site at relatively high speed, it is preferable that the position data be available at a rate exceeding 20 position measurements per second. As the bulldozer 106 moves forward, the frame 108 will typically be subjected to impact and vibrations transmitted through the cutting blade 110, and through tracks 132. As a consequence, the frame 108 may pitch forward and aft, pitch side to side, yaw from side to side, and bounce up and down. All of these movements of the frame will directly affect the position of the cutting blade 110. For example, when the frame 108 pitches fore and aft, it rotates about a generally horizontal axis, perpendicular to the direction of travel, that extends through the center of gravity 134 of the bulldozer 106. This angular movement of the frame 108, as well as the rest of the bulldozer 106, including the blade 110, rotates the blade by an angle $\alpha$. It will be appreciated that since the blade 110 extends in front of the bulldozer 106, the impact of this rocking fore and aft can be significant. This change is elevation may approximate.

$$\Delta\text{Elevation}=\text{Sin}\ \Delta\alpha\times\text{length}\ A$$

When the frame 108 pitches from side to side, this impacts the position of the blade 110. This movement is, in effect, rotation of the frame 108 about an axis that extends longitudinally with respect to the bulldozer 106 and passes through its center of gravity. This causes the tilt angle of the blade 110 to fluctuate.

Yawing of the frame 108, that is, rotating the frame 108 about a generally vertical axis, changes the orientation of the blade 110. Yawing moves the blade 110 to the side and changes the anticipated path of the bulldozer 106. Finally, when the frame 108 is bounced vertically as the bulldozer is driven over rough ground at the job site, the blade 110 will typically be bounced vertically, as well.

If the bulldozer is moving slowly, then the position measurements made with the GPS receivers 126 may be sufficient for the control of the bulldozer. When the bulldozer is driven at a higher speed over the jobsite, however, the amount of positional error produced as outlined above increases dramatically, and the pace at which this positional error is inserted into the position data used by the system also increases.

Figure 2:
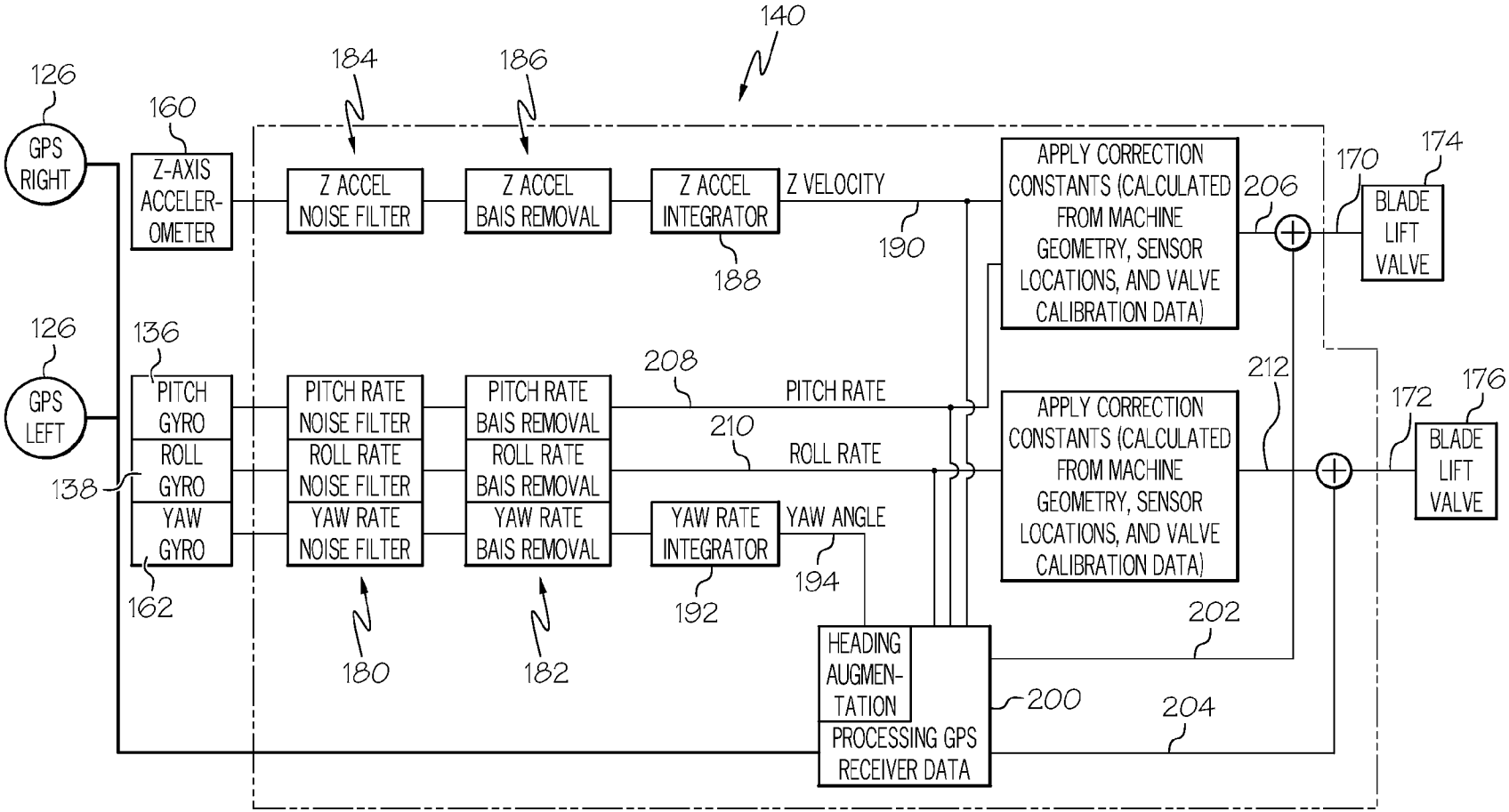
FIG. 2 is a schematic diagram illustrating the control in the earthmoving system of FIG. 1.

The system of FIGS. 1 and 2 monitors vertical movement of the frame 108, pitching movement fore and aft of the frame 108 about a horizontal transverse axis, rolling movement of the frame 108 about a longitudinally extending axis, and yawing of the frame 108 about a generally vertical axis at rates that are higher than the rate at which the system repetitively recalculates the positions of the GPS receivers 126. As a consequence, compensation for the short term fluctuations in the frame movement which would otherwise be passed on to the blade 110 can be made by quickly actuating the hydraulic cylinders 114 and 123 which control the position of the blade 110 with respect to the frame 108. A first gyroscopic sensor 136 is provided for sensing rotation of the frame 108 about an axis 150 that is generally transverse to the bulldozer and that passes through the center of gravity of the bulldozer. The sensor 136 provides an output that is related to the rate of rotation about axis 150. A second gyroscopic sensor 138 is provided for sensing rotation of the frame 108 about an axis 152 that is generally longitudinal with respect to the bulldozer 106 and that passes through the center of gravity 134 of the bulldozer. The sensor 138 provides an output that is related to the rate of rotation about axis 152.

A control 140 is responsive to the pair of GPS receivers 126 and to the first and second gyroscopic sensors 136 and 138, and controls the operation of the hydraulic cylinders 114 and 123, and thereby the position of the cutting blade 110. The control 140 monitors the position of the cutting blade 110 with repeated calculations based on the outputs of the GPS receivers 126 and with low-latency feed-forward correction of the repeated calculations based on the outputs of the first and second gyroscopic sensors 136 and 138. Based upon the outputs of the first and second gyroscopic sensors 136 and 138, the control 140 determines the rapid changes in the position of the cutting blade 110 that result from similarly rapid movement of the frame 108 of the bulldozer 106. The control 140 periodically updates the actual position of the cutting blade 110 based upon the outputs of the GPS receivers 126.

An accelerometer 160 may also be mounted on the frame 108 of the bulldozer for sensing generally vertical movement of the entire frame 108. The accelerometer 160 provides a vertical acceleration output to the control 140, whereby the control 140 may determine rapid changes in the position of the frame which may be transmitted to the cutting blade based on the output of the accelerometer. The control 140 monitors the position of the cutting blade 110 with repeated calculations based on the outputs of the GPS receivers 126 and with low-latency feed-forward correction of the repeated calculations based on the outputs of the first and second gyroscopic sensors 136 and 138, and the accelerometer 160.

The control 140 may also be responsive to the GPS receivers 126 to determine the heading of the bulldozer 106. The system may further comprise a third gyroscopic sensor 162 that senses rotation of the frame about a generally vertical axis 164 that passes through the center of gravity 134 of the bulldozer 106. The generally vertical axis 164 is perpendicular to both the axis 150 generally transverse to the bulldozer and the axis 152 generally longitudinal with respect to the bulldozer. The control 140 monitors the heading of the bulldozer with repeated calculations based on the outputs of the GPS receivers 126 and with low-latency feed-forward correction of the repeated calculations based on the output of the third gyroscopic sensor 162.

FIG. 2 is a schematic diagram, depicting the control 140 in somewhat greater detail. The control 140 is responsive to the GPS receivers 126 and to the gyroscopic position sensors 136, 138, and 162, as well as accelerometer 160, for generating signals on lines 170 and 172 to control blade lift valve 174 and blade tilt valve 176. Valve 174 controls the application of hydraulic fluid to hydraulic cylinders 114, while valve 176 controls the application of hydraulic fluid to hydraulic cylinder 123. The gyro outputs from gyroscopic sensors 136, 138, and 162 are applied to noise filters 180 and bias removal circuits 182. The output from the accelerometer 160 is applied to noise filter 184 and bias removal circuit 186, before being supplied to integrator circuit 188 to produce a Z velocity output on line 190. Similarly, the sensor 162 has its output applied to one of filters 180 and to one of bias removal circuits 182 before it is integrated in integrator circuit 192 to produce a Yaw Angle output on line 194.

It will be appreciated that both the height of the blade 110 and its tilt will be determined using the outputs from the GPS receivers 126. The processor circuit 200 provides control signals on lines 202 and 204 to valves 172 and 176, respectively, in response to the GPS outputs, so that the blade 110 can be raised and oriented, as desired. This control approach works well when the bulldozer is driven slowly over a relatively smooth worksite surface. When the bulldozer travels at a higher rate of speed and when the surface over which it travels is somewhat rougher, however, the frame 108 of the bulldozer is subjected to rapid vertical movement, and rapid fore and aft pitching, The GPS algorithm calculations may not be accomplished at a rate that allows for sufficiently rapid compensation for the resulting erroneous vertical movement of the blade 110.

In order to compensate for these rapid vertical disturbances, the control valve signal on line 202 is adjusted by combining it with a with low-latency feed-forward correction signal on line 206 derived from the outputs of the first gyroscopic sensor 136 and the z-axis accelerometer 160. It will be appreciated that the pitch rate on line 208 and the z-velocity signal on line 190 will be multiplied by appropriate constants related to the machine geometry, sensor location and the valve calibration data for valve 174, and combined to provide the low-latency correction signal. This signal corrects the signal on line 202 on a short term basis between GPS position calculations. Similarly, the roll rate signal on line 210 is multiplied by a correction constant based on the machine geometry, sensor location and valve calibration data to provide a low-latency feed-forward correction signal on line 212. The signal on line 212 is combined with the signal on line 204, and the rapid changes in the tilt of the blade 110 are compensated by equally rapid changes in the position of the tilt cylinder 123.

Finally, FIG. 2 also shows the use of yaw gyroscopic sensor 162 for determining the rotation of the frame 108 about a generally vertical axis of rotation. The yaw angle signal on line 194 is used to make rapid, short term adjustments in the heading data in processor 200.

Readings from sensors 136, 138, 160, and 162 are asynchronous. The digital processing of these sensors is used to implement functions 184, 180, 186, 182, 188, and 192, shown in the block diagram, FIG. 2. The sensors are read at a significantly higher data rate than the GPS measurements, in the range of 500 Hz to 1000 Hz. The processor may use a "timestamp" to keep track of the GPS readings relative to the inertial sensor readings. The timestamp accuracy will exceed 1 to 2 milliseconds. Greater accuracy may be achieved, if needed, at the expense of computational overhead, by implementing a form of sample interpolation.

As will be noted, this embodiment can operate without monitoring whether the blade is rotated and the amount of the rotation, although the feed-forward correction to the blade cylinders will be degraded in accuracy with increasing blade rotation. However, since this correction is dynamic in nature, only dynamic errors will be generated. No long term blade elevation errors will occur since the fixed reference position sensors are mounted on the blade, repeatedly providing the correct position information. The magnitude of such dynamic errors will be related to the product of the magnitude of the perturbations in the orientation of the machine body, and the magnitude of the blade rotation about a generally vertical axis.

The pair of GPS receivers 126 are shown in FIGS. 1 and 2 as providing fixed reference positions with respect to the blade 110. If desired, however, this system may be implemented with other types of position sensors or combinations of types of position sensors mounted on the blade 110 or on masts 128 carried by the blade. For example, pairs of laser receivers, sonic trackers, total station targets or prisms, or other types of fixed reference position sensors may be provided on the blade 110 in lieu of the pair of GPS receivers. Alternatively, combinations of these sensors or a combination of one of these sensors with a blade slope sensor may be used.

It will be appreciated that, as shown and described above, correction may be made with respect to rotation of the frame 108 about three orthogonal axes, as well as linear vertical movement of the frame in the manner described above. However, fewer modes of correction may be accomplished, if desired. Further, although separate gyroscopic sensors are illustrated, a single inertial component may be used to determine rotation about multiple axes.

What is claimed is:

1. An earthmoving system, comprising:

a bulldozer, having a frame and a cutting blade supported by a blade support extending from said frame, said blade support including a pair of hydraulic cylinders for raising and lowering said blade in relation to said frame and a blade tilt cylinder for controlling the lateral tilt of the cutting blade, pair of GPS receivers mounted on said cutting blade of said bulldozer for receiving GPS signals and providing outputs indicating position, a first gyroscopic sensor for sensing rotation of said frame about an axis generally transverse to said bulldozer and passing through the center of gravity of said bulldozer and providing an output, a second gyroscopic sensor for sensing rotation of said frame about an axis generally longitudinal with respect to said bulldozer and passing through the center of gravity of said bulldozer and providing an output, and a control, responsive to said pair of GPS receivers and to said first and second gyroscopic sensors, for controlling the operation of said hydraulic cylinders and thereby the position of said cutting blade, said control monitoring the position of said cutting blade with repeated calculations based on the outputs of said GPS receivers and with low-latency feed-forward correction of said repeated calculations based on the outputs of said first and second gyroscopic sensors.

2. The earthmoving system of claim 1, in which said control determines rapid changes in the position of said cutting blade based upon the outputs of said first and second gyroscopic sensors, and in which said control periodically updates the position of said cutting blade based upon the outputs of said GPS receivers.

3. The earthmoving system of claim 1, further comprising an accelerometer mounted on said frame for determining vertical movement of said frame, said accelerometer providing a vertical acceleration output to said control whereby said control may determine rapid changes in the position of said frame which may be transmitted to said cutting blade based on the output of said accelerometer, said control monitoring the position of said cutting blade with repeated calculations based on the outputs of said GPS receivers and with low-latency feed-forward correction of said repeated calculations based on the outputs of said first and second gyroscopic sensors and said accelerometer.

4. The earthmoving system of claim 3, in which said control is responsive to said GPS receivers to determine the heading of said bulldozer, said system further comprising a third gyroscopic sensor for sensing rotation of said frame about a generally vertical axis passing through said center of gravity of said bulldozer, said generally vertical axis being perpendicular to both said axis generally transverse to said bulldozer and said axis generally longitudinal with respect to said bulldozer, said control monitoring the heading of said bulldozer with repeated calculations based on the outputs of said GPS receivers and with low-latency feed-forward correction of said repeated calculations based on the output of said third gyroscopic sensor.

5. An earthmoving system, comprising:

an earthmoving machine, having a frame and a cutting blade supported by a blade support extending from said frame, said blade support including a pair of hydraulic cylinders for raising and lowering said blade in relation to said frame and a blade tilt cylinder for controlling the lateral tilt of the cutting blade, a pair of GPS receivers mounted on said cutting blade of said earthmoving machine for receiving GPS signals and providing outputs indicating position, a gyroscopic sensor system for sensing rotation of said frame about three orthogonal axes generally passing through the center of gravity of said machine, and a control, responsive to said GPS receivers and to said gyroscopic position sensor, for detecting the change in position of the cutting blade and controlling the operation of said cylinders and thereby controlling the position of said cutting blade, repeated calculations based on the outputs of said GPS receivers being corrected by low-latency feed-forward correction signals based on the output of said gyroscopic sensor system.

6. The earthmoving system of claim 5, in which said control periodically updates the position of said cutting blade based upon the outputs of said GPS receivers.

7. The earthmoving system of claim 6, in which said control determines the position of said cutting blade based upon the output of said gyroscopic system a plurality of times between successive determinations of the position of said cutting blade based upon the output of said GPS receivers.

8. The earthmoving system of claim 5, in which said control is responsive to said GPS receivers to determine the heading of said bulldozer, said gyroscopic system sensing rotation of said frame about a generally vertical axis passing through said center of gravity of said bulldozer, said control monitoring the heading of said bulldozer with repeated calculations based on the outputs of said GPS receivers and with low-latency feed-forward correction of said repeated calculations based on the output of said gyroscopic system.

9. The earthmoving system of claim 5, further comprising an accelerometer mounted on said frame for determining vertical movement of said frame, said accelerometer providing a vertical acceleration output to said control whereby said control may determine rapid changes in the position of said frame which may be transmitted to said cutting blade based on the output of said accelerometer, said control monitoring the position of said cutting blade with repeated calculations based on the outputs of said GPS receivers and with low-latency feed-forward correction of said repeated calculations based on the outputs of said gyroscopic system and said accelerometer.

10. A method of determining the position of the cutting blade of a bulldozer, said bulldozer having a frame and said cutting blade, said cutting blade supported by a blade support extending from said frame, said blade support including a pair of hydraulic cylinders for raising and lowering said blade in relation to said frame and a blade tilt cylinder for controlling the lateral tilt of the cutting blade, comprising the steps of:

periodically determining the location of the cutting blade using a pair of GPS receivers on masts mounted on said cutting blade, said GPS receivers providing outputs indicating their locations, sensing rotation of said frame about an axis using a first gyroscopic sensor, said axis being generally transverse with respect to said bulldozer and passing through the center of gravity of said bulldozer, said first gyroscopic sensor providing an output, sensing rotation of said frame about an axis using a second gyroscopic sensor, said axis being generally longitudinal with respect to said bulldozer and passing through the center of gravity of said bulldozer, said second gyroscopic sensor providing an output, controlling the operation of said cylinders and thereby the position of said cutting blade based upon the location of the cutting blade determined using the outputs of said GPS receivers, as updated with low-latency feed-forward correction signals derived from the outputs of said first and second gyroscopic sensors.

11. A method of determining the position of the cutting blade of a bulldozer, said bulldozer having a frame and said cutting blade, said cutting blade supported by a blade support extending from said frame, said blade support including a pair of hydraulic cylinders for raising and lowering said blade in relation to said frame and a blade tilt cylinder for controlling the lateral tilt of the cutting blade, said bulldozer further comprising a gyroscopic system mounted on said frame and having an output indicating position, and a pair of GPS receivers having outputs indicating position, comprising the steps of:

sensing rotation of said frame about each of three orthogonal axes that pass through the center of gravity of said bulldozer using said gyroscopic system, controlling the operation of said cylinders and thereby the position of said cutting blade based upon the output of said gyroscopic system, and periodically updating the position of said cutting blade as determined with said GPS receivers.

12. The method of determining the position of the cutting blade of a bulldozer according to claim 11 in which said bulldozer further includes an acceleration sensor mounted on said frame for determining vertical acceleration, and in which the operation of said cylinders and thereby the position of said cutting blade is controlled based upon the output of said gyroscopic system, the output of said acceleration sensor, and the outputs of the GPS receivers.

13. The method of determining the position of the cutting blade of a bulldozer according to claim 11, further comprising the step of determining the position of said cutting blade based upon the output of said gyroscopic system a plurality of times between each successive determination of the position of said cutting blade using said GPS receivers.

14. The method of claim 13, in which said bulldozer includes an accelerometer on said frame and in which correction is further made in the position of said cutting blade based on the output of said accelerometer.

15. The method of claim 14, in which said correction is made in the position of said cutting blade based on the output of said accelerometer and the output of said gyroscopic system by providing low-latency feed-forward correction.

* * * * *